US007008249B2

(12) United States Patent
McCoy et al.

(10) Patent No.: US 7,008,249 B2
(45) Date of Patent: Mar. 7, 2006

(54) SELECTABLE RECEPTACLE

(75) Inventors: Phillip A. McCoy, Albion, IN (US); Donald E. DeWitt, Syracuse, IN (US)

(73) Assignee: Pant Technologies, Inc., Kendallville, IN (US)

( * ) Notice: Subject to any disclaimer, the term of this patent is extended or adjusted under 35 U.S.C. 154(b) by 0 days.

(21) Appl. No.: 11/032,860

(22) Filed: Jan. 11, 2005

(65) Prior Publication Data

US 2005/0124195 A1 Jun. 9, 2005

Related U.S. Application Data

(63) Continuation-in-part of application No. 10/438,139, filed on May 14, 2003, now abandoned.

(51) Int. Cl.
*H01R 4/60* (2006.01)

(52) U.S. Cl. ..... 439/215; 439/171

(58) Field of Classification Search ..... 200/51.03, 200/51.05, 51.06; 439/174, 171, 215–217, 439/52

See application file for complete search history.

(56) References Cited

U.S. PATENT DOCUMENTS

| | | | | |
|---|---|---|---|---|
| 2,313,960 | A * | 3/1943 | O'Brien | 439/216 |
| 3,034,000 | A | 5/1962 | Todd | 307/156 |
| 3,317,880 | A * | 5/1967 | Meyer | 439/174 |
| 4,367,370 | A | 1/1983 | Wilson et al. | 174/48 |
| 4,386,333 | A | 5/1983 | Dillan | 336/107 |
| 4,666,223 | A | 5/1987 | Tillmann | 200/51.06 |
| 5,038,005 | A | 8/1991 | Hohorst et al. | 200/51.06 |
| 5,096,431 | A | 3/1992 | Byrne | 439/171 |
| 5,236,370 | A | 8/1993 | King et al. | 439/215 |
| 5,241,143 | A | 8/1993 | Adams | 200/51.05 |
| 5,503,565 | A | 4/1996 | McCoy | 439/171 |
| 5,577,923 | A | 11/1996 | Lee | 439/170 |
| 5,584,714 | A | 12/1996 | Karst et al. | 439/215 |
| 5,660,554 | A | 8/1997 | Mead | 439/172 |
| 5,902,148 | A | 5/1999 | O'Rourke | 439/505 |
| 6,575,777 | B1 * | 6/2003 | Henriott et al. | 439/215 |
| 2002/0148179 | A1 | 10/2002 | DeRuiter et al. | 52/220.7 |

* cited by examiner

*Primary Examiner*—Hien Vu
(74) *Attorney, Agent, or Firm*—Taylor & Aust, P.C.

(57) ABSTRACT

A modular electrical receptacle including a housing, a plurality of semi-rigid electrical conductors disposed at least partially within the housing including a first semi-rigid conductor and a second semi-rigid conductor and at least one flexible electrical conductor including a first flexible conductor electrically connecting the first semi-rigid conductor and the second semi-rigid conductor.

30 Claims, 6 Drawing Sheets

SELECTABLE RECEPTACLE

CROSS REFERENCE TO RELATED APPLICATIONS

This is a continuation-in-part of U.S. patent application Ser. No. 10/438,139, entitled "SELECTABLE RECEPTACLE", filed May 14, 2003 now abandoned.

BACKGROUND OF THE INVENTION

1. Field of the Invention

The present invention relates to an electrical outlet receptacle, and, more particularly, to a modular electrical outlet receptacle.

2. Description of the Related Art

Modular outlet receptacles may be included in modular office partitions and they provide flexibility in terms of system layout and interconnectability to other components of the electrical system. Typically, such a modular electrical receptacle includes at least one connector, which is adapted to interface with a corresponding connector or wiring harness. A wiring harness typically includes electrical connectors at opposing ends thereof, which extend to another component of the electrical system such as another electrical receptacle. The connector of the electrical receptacle also includes contacts, which are electrically connected to each of line, neutral and ground conductors disposed within the modular electrical receptacle.

A problem with known modular electrical receptacles is that they must be configured before assembly or disassembled in order to be reconfigured. A typical configuration process includes selecting conductors and inserting them within the electrical modular receptacle in order to configure the modular electrical outlet relative to line, neutral and ground conductors.

What is needed in the art is a modular electrical receptacle, which can be easily reconfigured.

SUMMARY OF THE INVENTION

The present invention provides a selectable receptacle including a housing, at least one plug-in connector and a faceplate having parallel blade openings.

The invention comprises, in one form thereof, a modular electrical receptacle including a housing, a plurality of semi-rigid electrical conductors disposed at least partially within the housing including a first semi-rigid conductor and a second semi-rigid conductor and at least one flexible electrical conductor including a first flexible conductor electrically connecting the first semi-rigid conductor and the second semi-rigid conductor.

An advantage of the present invention is that a selectable receptacle is easily reconfigured.

Another advantage is that a selecting switch is on the side of the receptacle thereby inhibiting office personnel from changing the configuration of the selectable receptacle.

Yet another advantage of the present invention is that the receptacle can be reconfigured without needing additional stamped conductors.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
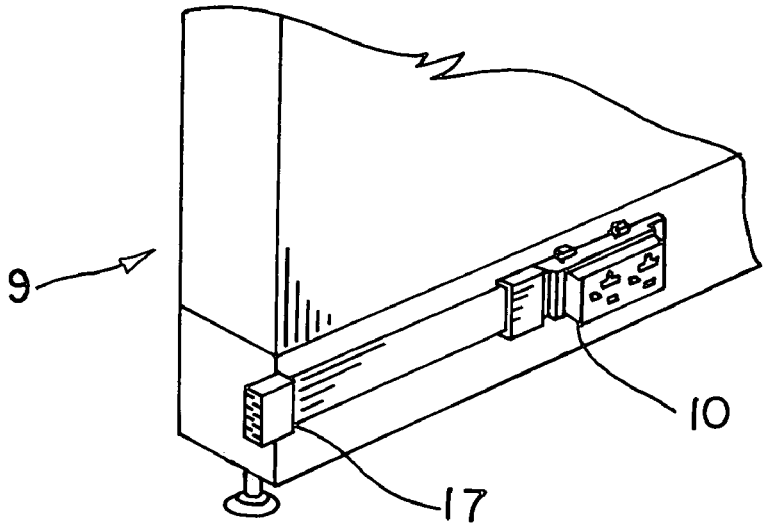
FIG. 1 is a perspective view of an embodiment of a selectable electrical receptacle of the present invention installed in a modular wall panel.
Figure 2:
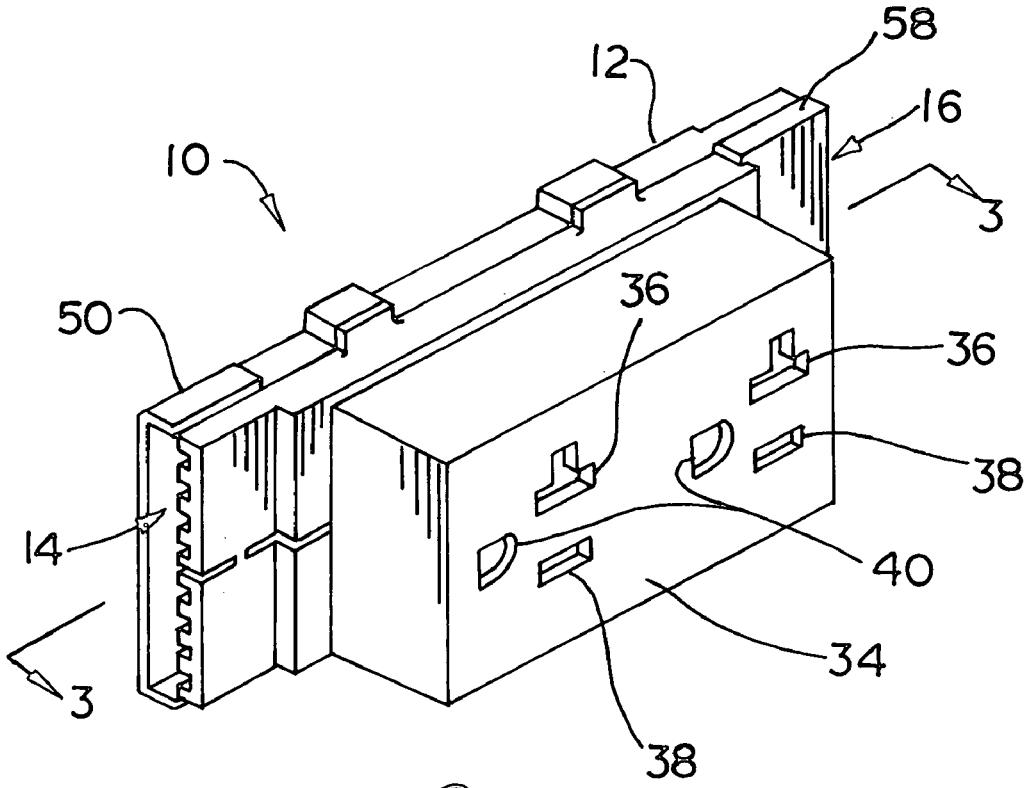
FIG. 2 is a perspective view of the selectable electrical receptacle shown in FIG. 1.
Figure 3:
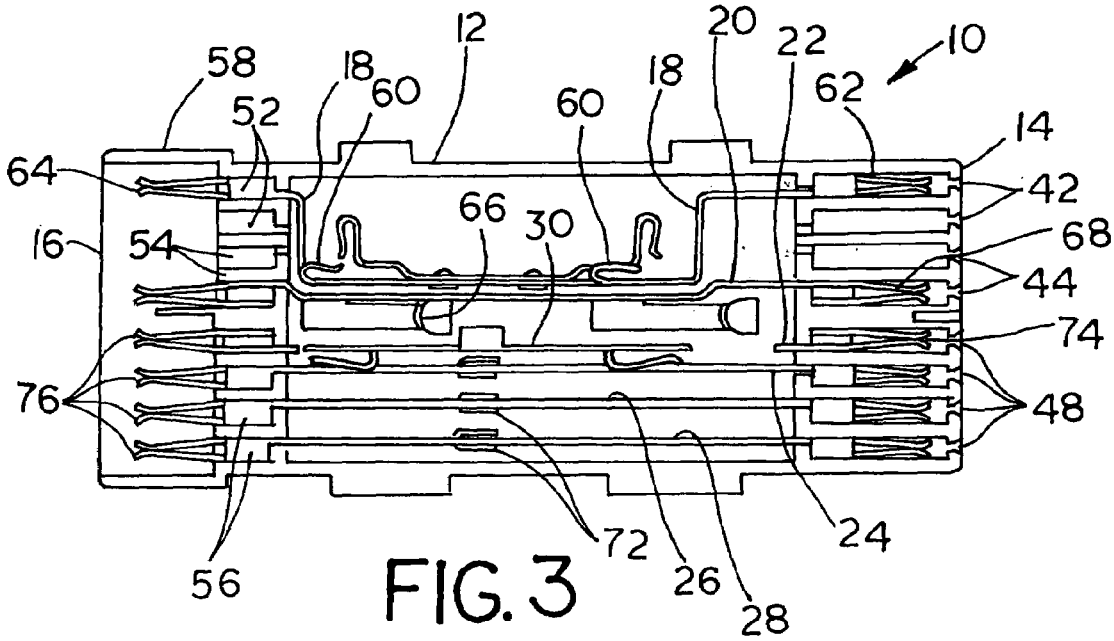
FIG. 3 is a sectional view taken along line 3—3 of the selectable electrical receptacle of FIGS. 1 and 2.

Referring now to the drawings, and more particularly to FIGS. 1–3 and 6, there is shown an embodiment of a selectable electrical receptacle 10 of the present invention installed in modular wall panel 9 and connected to wiring harness 17. Selectable receptacle 10 includes a housing 12, plug-in electrical connectors 14 and 16, neutral conductor 18, ground conductor 20, line conductors 22, 24, 26 and 28, switched line conductor 30 and line selector 32.

Housing 12 includes faceplate 34 and back cover 35. Faceplate 34 is attached to housing 12 or alternatively faceplate 34 can be integral with housing 12. Faceplate 34 has a pair of first parallel blade openings 36, a second pair of second blade openings 38 and ground blade openings 40. First blade openings 36 and second blade openings 38 are generally parallel to each other with first pair of blade openings 36 allowing access to switched line conductor 30 within housing 12. Second pair of blade openings 38 allow electrical access to ground conductor 20 within housing 12. Ground blade openings 40 are arranged to accommodate the ground blade of a standard electrical plug.

Plug-in electrical connector 14 has openings 42, 44 and 48, and plug-in electrical connector 16 has openings 52, 54 and 56. Openings 42 and 52 accommodate ends of neutral conductor 18; openings 44 and 54 accommodate ends of ground conductor 20; and likewise openings 48 and 56 accommodate ends of line conductors 22, 24, 26 and 28.

Neutral conductor 18 includes two parallel blade sockets 60, a first electrical contact 62 and a second electrical contact 64. Parallel blade sockets 60 are disposed to accommodate a neutral blade from an electrical plug that would enter through one of first blade openings 36 on faceplate 34. First electrical contact 62 is disposed within opening 42 and second electrical contact 64 is disposed within opening 52.

Ground conductor 20 includes two ground blade sockets 66 disposed and oriented towards ground blade opening 40 to accommodate a ground blade from a typical electrical plug. First electrical contact 68 is disposed at least partially within opening 44 and second electrical contact 70 is at least partially disposed within opening 54. The arrangement of ground conductor 20 in openings 44 and 54 allow for electrical conduction between plug-in electrical connector 14 and plug-in electrical connector 16.

Figure 4:
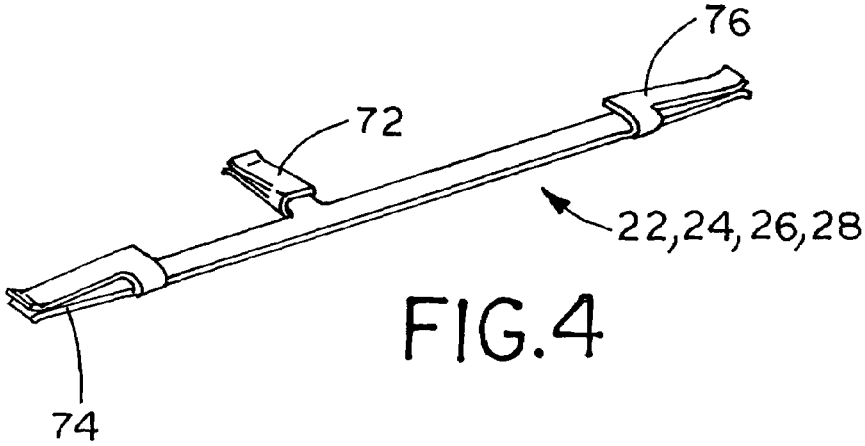
FIG. 4 is a perspective view of a line conductor of the selectable electrical receptacle that is shown in FIG. 3.

Now, additionally referring to FIG. 4, there is shown line conductors 22, 24, 26 and 28 each having a switch contact 72, a first electrical contact 74 and a second electrical contact 76. First and second electrical contacts 74 and 76 are, respectively, arranged in corresponding openings 48 and 56. This arrangement allows electrical conduction of line current from plug-in electrical connector 14 through housing 12 to plug-in electrical connector 16. Switch contact 72 interfaces with line selector 32 to select electrical current from one of line conductors 22, 24, 26 and 28 and route the selected current to switched line conductor 30.

Figure 5:
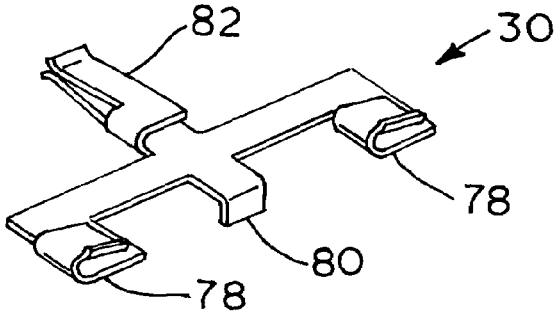
FIG. 5 is a perspective view of the switched line conductor of the selectable electrical receptacle that is shown in FIG. 3.

Now, additionally referring to FIG. 5, there is shown switched line conductor 30 including two blade sockets 78, retaining portion 80 and switch contact 82. Blade sockets 78 are arranged proximate to the pair of second blade openings 38 to provide electrical connection from the line circuit to a standard electrical plug. Retaining portion 80 interconnects with a portion of housing 12 to retain switched line conductor 30 and thereby position switched line conductor 30 within housing 12. Switched contact 82 electrically connects blade sockets 78 with line selector 32.

Figure 6:
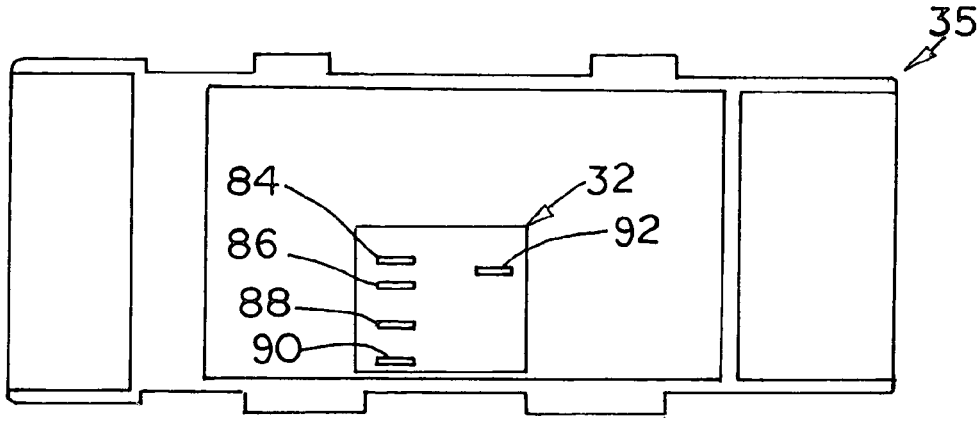
FIG. 6 is an inside view of the back cover of the selectable electrical receptacle of FIGS. 1–3.
Figure 7:
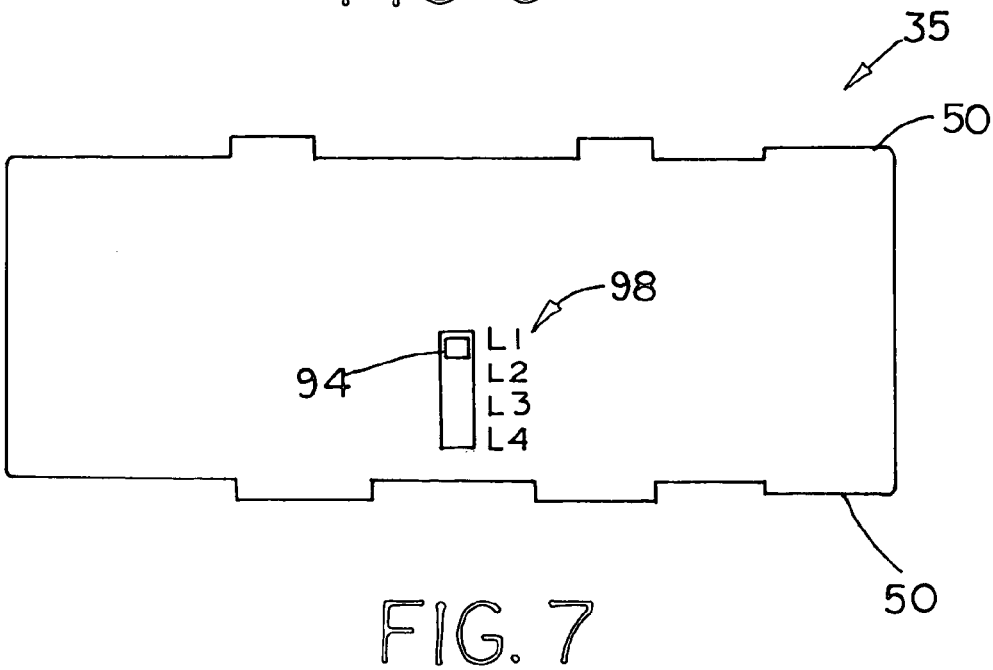
FIG. 7 is an outside view of the back cover of the selectable receptacle shown in FIG. 6.

Now, additionally referring to FIGS. 6 and 7 there is shown back cover 35 with line selector 32 mounted therein. Line selector 32 includes line conductor connections 84, 86, 88 and 90; selected line output 92; four-position electrical switch 94 and legend 98. Line conductor connections 84, 86, 88 and 90, respectively, electrically connect with switch contact 72 of each line connector 22, 24, 26 and 28. Selected line output 92 is oriented to electrically connect with switch contact 82 of switched line conductor 30.

Four-position electrical switch 94 operates in a break before make capacity and it electrically connects one of line conductors 22, 24, 26 or 28 with switched line conductor 30 thereby allowing an operator to select one of the four line circuits to be electrically connected to switched line conductor 30. Four-position switch 94 is illustrated as a slide switch although another type of multiple-pole switch may be utilized, such as a rotary switch. Legend 98, on the backside of back cover 35, is a visual indication as to which line conductor 22, 24, 26 or 28, switched line conductor 30 is connected.

Flanges 50 and 58, respectively associated with, plug-in connectors 16 and 14, coact to key plug-in connectors 14 and 16 with another selectable receptacle 10 or a mating electrical connector from wiring harness 17. The keyed connection ensures that the connection preserves the polarities of the circuits. Plug-in electrical connectors 14 and 16 may be separate from or integral with housing 12 and back cover 35.

To configure selectable receptacle 10 such that one of line conductors 22, 24, 26 or 28 is electrically connected to switched line conductor 30, prior to inclusion in modular wall panel 9, an installer moves four-position switch 94 to the appropriate position according to legend 98. The installer then electrically interfaces selectable receptacle 10 with wiring harness 17 or another selectable receptacle 10 and installs the electrical assembly within modular wall panel system 9. Maintenance personnel may easily reconfigure selectable receptacle 10 by gaining access to the backside of selectable receptacle 10 and sliding switch 96 of line selector 32 between one of the four line circuit selections. The selection of a different line circuit can be accomplished whether or not receptacle 10 is electrically active.

Even though four line circuit selections have been shown in the accompanying drawings and described hereinabove more than or fewer than four line configurations may be provided. Alternatively, neutral and or ground conductors can likewise be configured to have separate selectable switches to easily configure multiple ground or neutral circuits as well. Also, line selector 32 may be a multiple-pole/multiple-throw switch, which selects predetermined sets of line, neutral and/or ground circuits.

Figure 8:
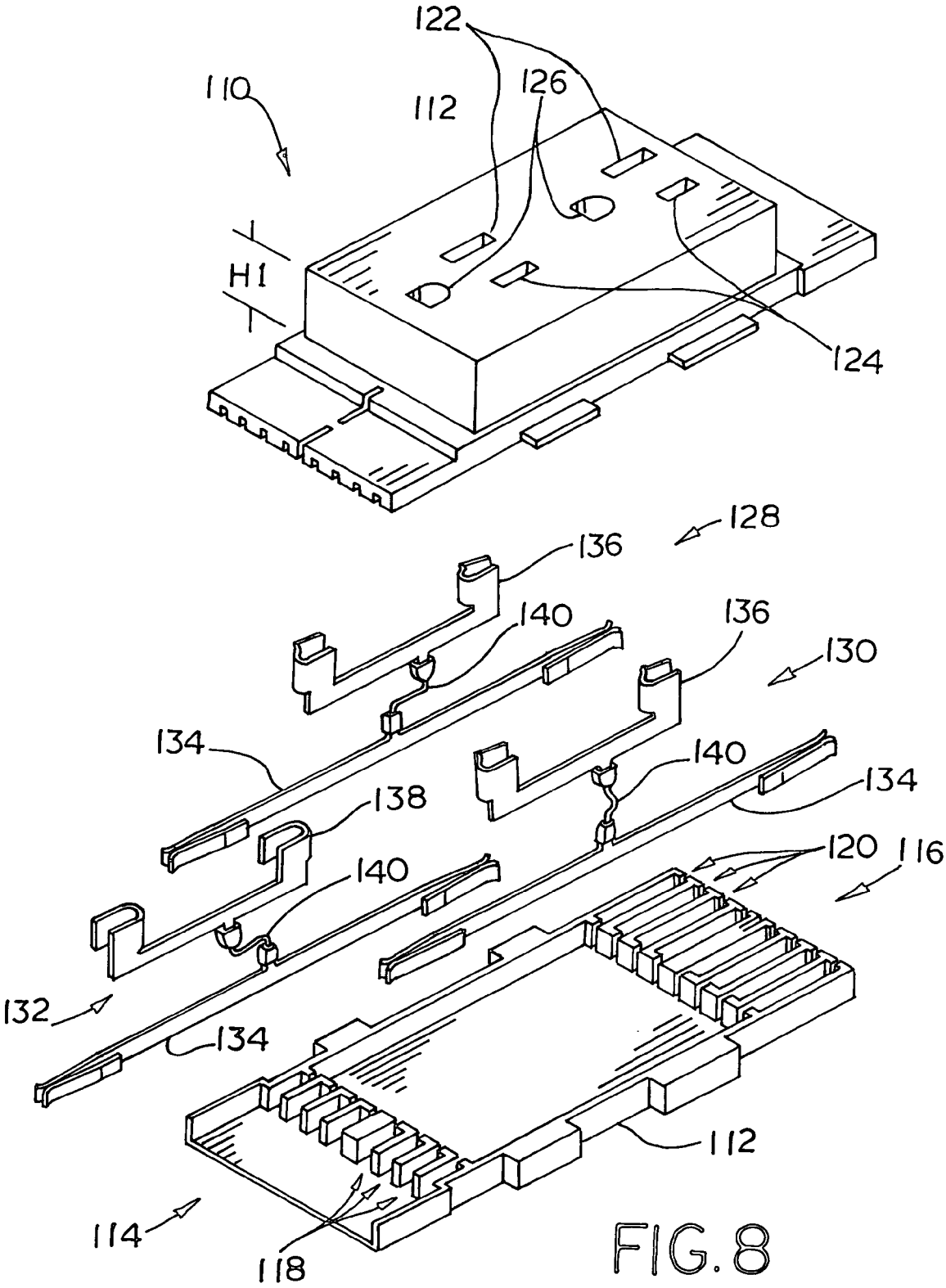
FIG. 8 is an exploded perspective view of another embodiment of a selectable electrical receptacle of the present invention.

Now, additionally referring to FIGS. 8–11 there are shown additional embodiments of the present invention. In FIG. 8 there is shown a modular receptacle 110 having a housing 112. Housing 112 includes two portions that are connected together once receptacle 110 is configured. Housing 112 includes connectors 114 and 116 which result when electrical conductors are installed therein. One portion of housing 112 includes positioning cavities 118 and 120, which are shaped to receive semi-rigid electrical conductors placed therein.

The other portion of housing 112 includes blade slots 122 and 124, and round slots 126. Slots 122, 124 and 124 are shown and configured as a duplex electrical outlet. Slots 122 are longer than slots 124 and are configured as neutral openings. Slots 124 are normally configured as power openings. Round openings 126 are configured to receive a ground plug from a grounded electrical plug.

Conductor assemblies 128, 130 and 132 include semi-rigid conductors and flexible conductors connecting each of two semi-rigid conductors electrically together. One portion of each conductor assembly 128, 130 and 132 has a portion that is inserted into one portion of housing 112 and another portion inserted into the other portion of housing 112. More specifically, assembly 130 includes a semi-rigid electrical conductor 134 and another semi-rigid electrical conductor 136, which are electrically connected to each other by a flexible conductor 140. The use of the term semi-rigid is used to define an assembly that when flexed will return to its preflexed state, but is otherwise rigid. For example, semi-rigid conductor 136 has been stamped and formed to receive a blade from an electrical plug. A portion of conductor 136 flexes out to accommodate the blade from a plug and to apply sufficient pressure to it to ensure good electrical contact. Once the blade is removed, the portion of conductor 136 that has been flexed returns to its former position. Semi-rigid conductors shown herein may be formed from stamped metal into the desired configuration. Use of the term flexible conductor includes braided wires, stranded wire, single strand wire and other flexible types of conductors, insulated or uninsulated.

In a like manner, assemblies 128, 130 and 132 share common stampings 134 in the form of semi-rigid conductors 134. Assemblies 128 and 130 each include a semi-rigid conductor 136. Assembly 132 includes an alternative stamping 138 in order to accommodate a ground plug lug. This advantageously allows conductors 134 to be positioned in cavities 118 and 120, to thereby configure receptacle 110. Flexible conductors 140 allow the positioning of semi-rigid conductors 134 in a variety of locations in housing 112.

Semi-rigid conductors 136 and 138 are positioned relative to respective slots 122, 124 and 126.

Advantageously, receptacle 110 may be disassembled and semi-rigid conductors 134 repositioned to otherwise configure receptacle 110. Additionally, receptacle 110 may have additional semi-rigid conductors 134 positioned therein, which are not electrically connected to any other semi-rigid conductors, and which serve to pass power through receptacle 110. This arrangement significantly reduces the number of stampings needed to configure receptacle 110 in a multitude of ways, since only three types of stampings are required in this embodiment of the present invention.

Flexible conductors 140 may be connected to semi-rigid conductors in a variety of ways including crimping, soldering, spot welding and the utilization of a connector such as a connector capable of receiving a spade connection. Retaining features in housing 112 provided to allow for the insertion, yet retention of semi-rigid conductors 134, 136 and 138 in their respective positions in housing 112.

Figure 9:
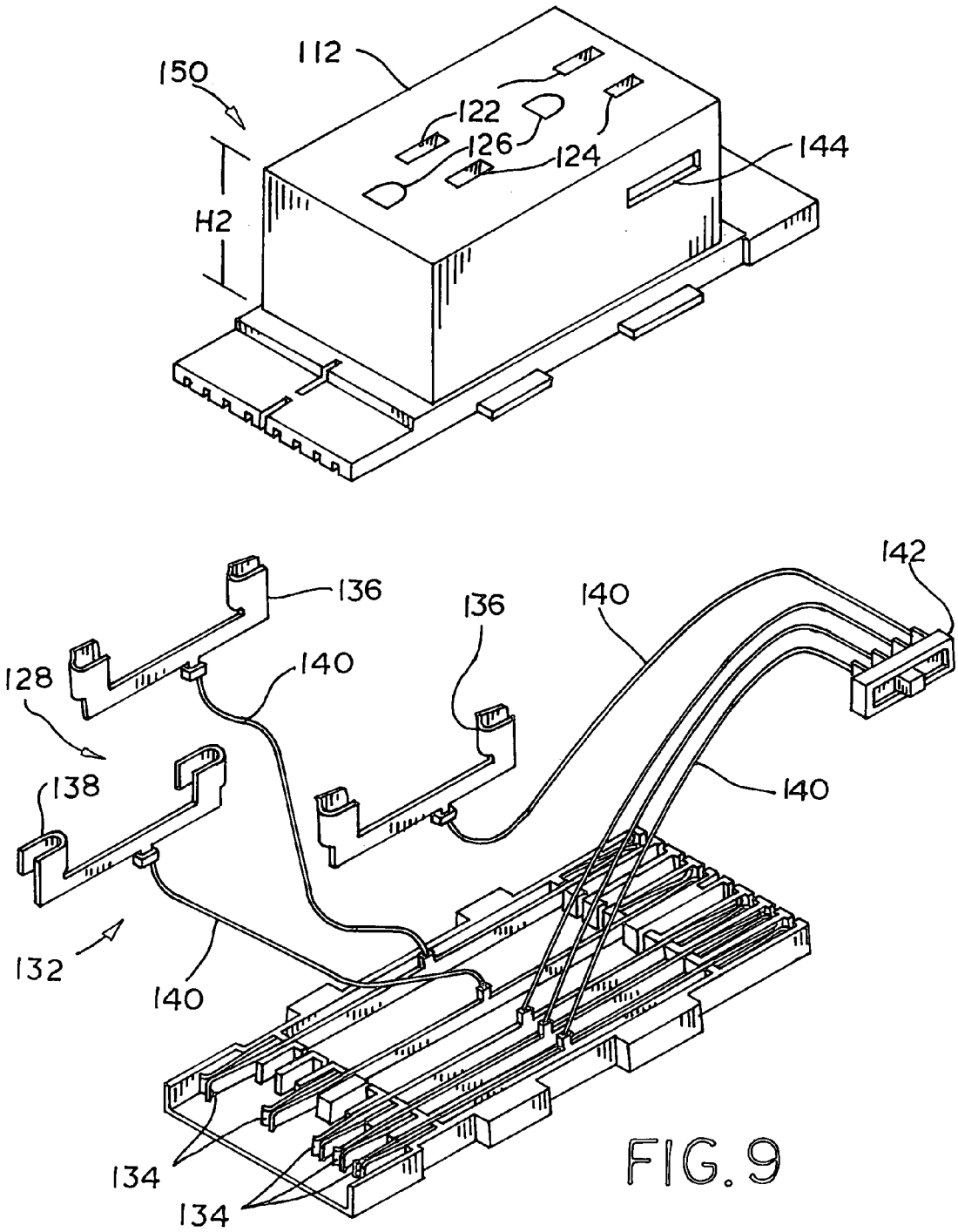
FIG. 9 is an exploded perspective view of yet another embodiment of a selectable electrical receptacle of the present invention.

FIG. 9 illustrates another modular receptacle assembly 150 having a housing 112 of a different height than that shown in FIG. 8. In FIG. 8 housing 112 includes a raised portion of height H1 and FIG. 9 shows housing portion 112 with a height of H2. Flexible conductors 140 are of sufficient length to allow use in either receptacle 110 or 150. This advantageously allows the use of the same configuration method illustrated relative to FIG. 8.

Additionally, FIG. 9 includes an illustration of multi-position switch 142 which is mounted in housing 112 proximate slot 144. In FIG. 9 assemblies 128 and 132 are each shown and are substantially the same as that illustrated in FIG. 8. However, switch 142 provides an electrical selection from three different circuits, which are hereinafter assumed to be power circuits by way of three electrical connections to three separate semi-rigid conductors 134. Switch 142 selectively selects one of these three circuits and applies an electrical connection to a semi-rigid conductor 136 associated and electrically connected to switch 142. In its assembled condition switch 142 is located along one side of housing 112 and allows for the selection of a power circuit without disassembling receptacle 150.

Figure 10:
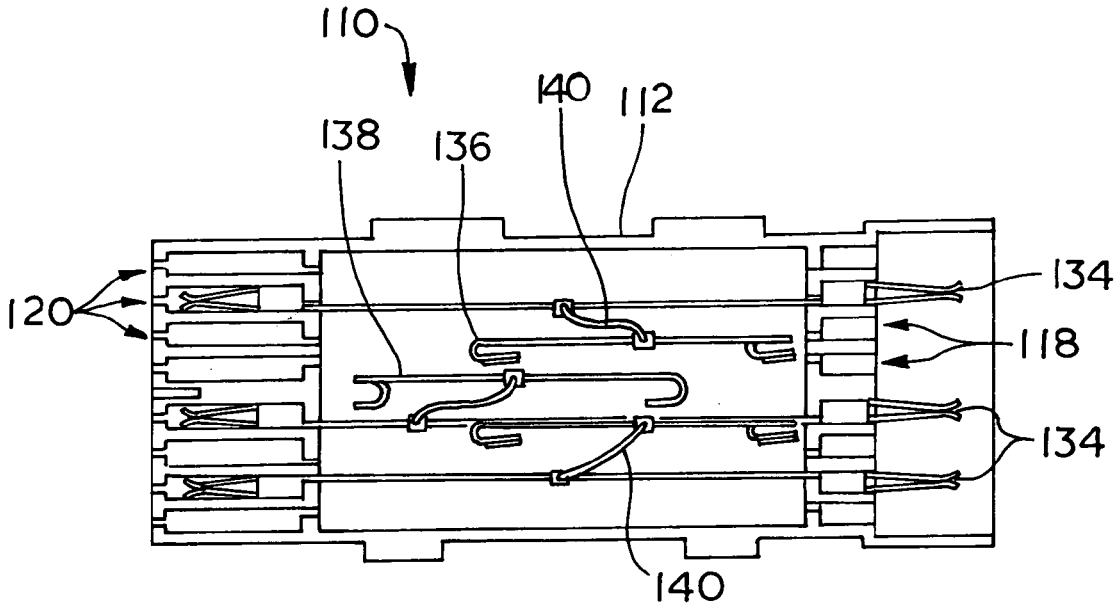
FIG. 10 is a top view of a lower portion of the housing of FIG. 8 or 9.
Figure 11:
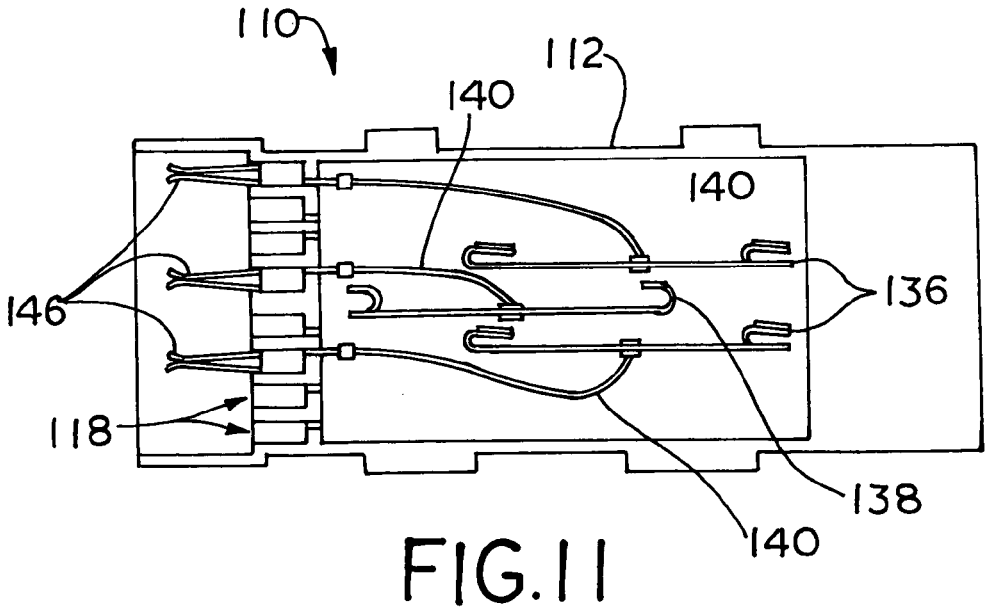
FIG. 11 is yet another embodiment of a selectable electrical receptacle.

FIG. 10 illustrates a top down view showing semi-rigid conductors 134–138 positioned in a typical configuration. Conductors 134 are positioned in positioning cavities 118 and 120 and can be repositioned in different cavities as desired by an assembler. FIG. 11 illustrates yet another embodiment of the present invention in that other semi-rigid conductors 146 are utilized, which are shortened versions of conductors 134 illustrated earlier. Conductors 146 are connected to flexible conductors 140, and are positioned relative to housing 112 for interaction with an electrical plug. Here again conductors 146 may be repositioned in cavities 118 to reconfigure receptacle 110. Although not shown, additional semi-rigid conductors 146 may be positioned in an opposite end and connected by additional flexible conductors 140, not shown.

The present invention advantageously allows for a reduced number of inventory items in order to produce a multitude of configured receptacles. This advantageously allows for the reconfiguration of the receptacle without the need of acquiring additional stampings to be positioned within the receptacle.

Although switch 142 has been illustrated as a sliding switch, a rotary switch or other type of switch may be utilized for electrically interconnecting semi-rigid conductors 134 with a semi-rigid conductor 136.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular electrical receptacle, comprising:

a housing having openings on a first end and an opposite second end;

a plurality of longitudinal semi-rigid electrical conductors disposed at least partially within said housing including a first longitudinal semi-rigid conductor and a second longitudinal semi-rigid conductor, said first semi-rigid conductor substantially traversing a distance from said first end to said second end, said first semi-rigid conductor and said second semi-rigid conductor each having a first contact and a second contact respectively at said first end and said second end; and at least one flexible electrical conductor including a first flexible conductor electrically connecting said first semi-rigid conductor and said second semi-rigid conductor, said first semi-rigid conductor, said second semi-rigid conductor and said first flexible conductor forming a first conductor assembly associated with one of a line circuit, a neutral circuit and a ground circuit, said at least one flexible electrical conductor being one of a braided wire, stranded wire and single strand wire.

2. The modular electrical receptacle of claim 1, wherein said plurality of semi-rigid conductors include a third semi-rigid conductor and a fourth semi-rigid conductor, said at least one flexible electrical conductor including a second flexible conductor, said second flexible conductor electrically connecting said third semi-rigid conductor and said fourth semi-rigid conductor thereby forming a second conductor assembly associated with said line circuit, said first conductor assembly being associated with said ground circuit.

3. The modular electrical receptacle of claim 2, wherein said plurality of semi-rigid conductors include a fifth semi-rigid conductor and a sixth semi-rigid conductor, said at least one flexible electrical conductor including a third flexible conductor, said third flexible conductor electrically connecting said fifth semi-rigid conductor and said sixth semi-rigid conductor thereby forming a third conductor assembly associated with said neutral circuit.

4. The modular electrical receptacle of claim 3, wherein said second conductor assembly and said third conductor assembly are substantially similar.

5. The modular electrical receptacle of claim 4, wherein said first semi-rigid conductor, said third semi-rigid conductor arid said fifth semi-rigid conductor are substantially similar, said fourth semi-rigid conductor and said sixth semi-rigid conductor being substantially similar.

6. The modular electrical receptacle of claim 1, wherein said plurality of semi-rigid electrical conductors have portions that when an electrical terminal is withdrawn the portion that is flexed will return to a preflexed state, but said semi-rigid electrical conductor is otherwise rigid.

7. The modular electrical receptacle of claim 1, wherein said first flexible conductor is electrically connected to said first semi-rigid conductor by one of crimping, soldering, spot welding and a connector.

8. The modular electrical receptacle of claim 1, wherein said housing includes a plurality of positioning cavities, at least one of said plurality of semi-rigid electrical conductors being selectively placed in at least one of said plurality of positioning cavities.

9. A modular electrical receptacle, comprising:

a housing;

a plurality of semi-rigid electrical conductors disposed at least partially within said housing including a first semi-rigid conductor and a second semi-rigid conductor;

at least one flexible electrical conductor including a first flexible conductor electrically connecting said first semi-rigid conductor and said second semi-rigid conductor; and an electrical switch, said plurality of semi-rigid electrical conductors further including a third semi-rigid conductor and a fourth semi-rigid conductor, said at least one flexible electrical conductor further including a second flexible conductor and a third flexible conductor, said second flexible conductor electrically connecting said third semi-rigid conductor to said switch and said third flexible conductor electrically connecting said switch to said fourth semi-rigid conductor.

10. The modular electrical receptacle of claim 9, wherein said switch selectively electrically connects one of said plurality of semi-rigid conductors to another of said plurality of semi-rigid conductors.

11. The modular electrical receptacle of claim 9, wherein said housing includes a faceplate located on a side of said housing, said switch being positioned on another side of said housing.

12. An electrical system assembly, comprising:

at least one interconnecting wire harness; and a modular electrical receptacle electrically connected to at least one said interconnecting wire harness, said modular electrical receptacle including:

a housing having openings on a first end and an opposite second end;

a plurality of longitudinal semi-rigid electrical conductors disposed at least partially within said housing including a first longitudinal semi-rigid conductor and a second longitudinal semi-rigid conductor, said first semi-rigid conductor substantially traversing a distance from said first end to said second end, said first semi-rigid conductor and said second semi-rigid conductor each having a first contact and a second contact respectively at said first end and said second end; and at least one flexible electrical conductor including a first flexible conductor electrically connecting said first semi-rigid conductor and said second semi-rigid conductor, said first semi-rigid conductor, said second semi-rigid conductor and said first flexible conductor forming a first conductor assembly associated with one of a line circuit, a neutral circuit and a ground circuit.

13. The electrical system assembly of claim 12, wherein said plurality of semi-rigid conductors include a third semi-rigid conductor and a fourth semi-rigid conductor, said at least one flexible electrical conductor including a second flexible conductor, said second flexible conductor electrically connecting said third semi-rigid conductor and said fourth semi-rigid conductor thereby forming a second conductor assembly associated with said line circuit, said first conductor assembly being associated with said ground circuit.

14. The electrical system assembly of claim 13, wherein said plurality of semi-rigid conductors include a fifth semi-rigid conductor and a sixth semi-rigid conductor, said at least one flexible electrical conductor including a third flexible conductor, said third flexible conductor electrically connecting said fifth semi-rigid conductor and said sixth semi-rigid conductor thereby forming a third conductor assembly associated with said neutral circuit.

15. The electrical system assembly of claim 14, wherein said second conductor assembly and said third conductor assembly are substantially similar.

16. The electrical system assembly of claim 15, wherein said first semi-rigid conductor, said third semi-rigid conductor and said fifth semi-rigid conductor are substantially similar, said fourth semi-rigid conductor an(l said sixth semi-rigid conductor being substantially similar.

17. The electrical system assembly of claim 12, wherein said at least one flexible electrical conductor is one of a braided wire, stranded wire and single strand wire.

18. The electrical system assembly of claim 17, wherein said plurality of semi-rigid electrical conductors have portions that when an electrical terminal is withdrawn the portion that is flexed will return to a preflexed state, but said semi-rigid electrical conductor is otherwise rigid.

19. The electrical system assembly of claim 12, wherein said first flexible conductor is electrically connected to said first semi-rigid conductor by one of crimping, soldering, spot welding and a connector.

20. The electrical system assembly of claim 12, wherein said housing includes a plurality of positioning cavities, at least one of said plurality of semi-rigid electrical conductors being selectively placed in at least one of said plurality of positioning cavities.

21. An electrical system assembly, comprising:

at least one interconnecting wire harness; and a modular electrical receptacle electrically connected to at least one said interconnecting wire harness, said modular electrical receptacle including:

a housing;

a plurality of semi-rigid electrical conductors disposed at least partially within said housing including a first semi-rigid conductor and a second semi-rigid conductor; and at least one flexible electrical conductor including a first flexible conductor electrically connecting said first semi-rigid conductor and said second semi-rigid conductor; and an electrical switch, said plurality of semi-rigid electrical conductors further including a third semi-rigid conductor and a fourth semi-rigid conductor, said at least one flexible electrical conductor further including a second flexible conductor and a third flexible conductor, said second flexible conductor electrically connecting said third semi-rigid conductor to said switch and said third flexible conductor electrically connecting said switch to said fourth semi-rigid conductor.

22. The electrical system assembly of claim 21, wherein said switch selectively electrically connects one of said plurality of semi-rigid conductors to another of said plurality of semi-rigid conductors.

23. A modular wall panel system, comprising:

a modular wall panel; and an electrical system assembly disposed at least partially within at least one said modular wall panel, said electrical system assembly including:

at least one interconnecting wire harness; and a modular electrical receptacle electrically connected to at least one said interconnecting wire harness, said modular electrical receptacle including:

a housing having openings on a first end and a an opposite second end;

a plurality of longitudinal semi-rigid electrical conductors disposed at least partially within said housing including a first longitudinal semi-rigid conductor and a second longitudinal semi-rigid conductor said first semi-rigid conductor substantially traversing a distance from said first end to said second end, said first semi-rigid conductor and said second semi-rigid conductor each having a first contact and a second contact respectively at said first end and said second end; and at least one flexible electrical conductor including a first flexible conductor electrically connecting said first semi-rigid conductor and said second semi-rigid conductor, said first semi-rigid conductor, said second semi-rigid conductor and said first flexible conductor forming a first conductor assembly associated with one of a line circuit, a neutral circuit and a ground circuit.

24. The system of claim 23, wherein said plurality of semi-rigid conductors include a third semi-rigid conductor and a fourth semi-rigid conductor, said at least one flexible electrical conductor including a second flexible conductor, said second flexible conductor electrically connecting said third semi-rigid conductor and said fourth semi-rigid conductor thereby forming a second conductor assembly associated with said line circuit, said first conductor assembly being associated with said ground circuit.

25. The system of claim 24, wherein said plurality of semi-rigid conductors include a fifth semi-rigid conductor and a sixth semi-rigid conductor, said at least one flexible electrical conductor including a third flexible conductor, said third flexible conductor electrically connecting said fifth semi-rigid conductor and said sixth semi-rigid conductor thereby forming a third conductor assembly associated with said neutral circuit.

26. The system of claim 25, wherein said second conductor assembly and said third conductor assembly are substantially similar.

27. The system of claim 26, wherein said first semi-rigid conductor, said third semi-rigid conductor and said fifth semi-rigid conductor are substantially similar, said fourth semi-rigid conductor and said sixth semi-rigid conductor being substantially similar.

28. A modular wall panel system, comprising:

a modular wall panel; and an electrical system assembly disposed at least partially within at least one said modular wall panel, said electrical system assembly including:

at least one interconnecting wire harness; and a modular electrical receptacle electrically connected to at least one said interconnecting wire harness, said modular electrical receptacle including:

a housing;

a plurality of semi-rigid electrical conductors disposed at least partially within said housing including a first semi-rigid conductor and a second semi-rigid conductor; and at least one flexible electrical conductor including a first flexible conductor electrically connecting said first semi-rigid conductor and said second semi-rigid conductor; and an electrical switch, said plurality of semi-rigid electrical conductors further including a third semi-rigid conductor and a fourth semi-rigid conductor, said at least one flexible electrical conductor further including a second flexible conductor and a third flexible conductor, said second flexible conductor electrically connecting said third semi-rigid conductor to said switch and said third flexible conductor electrically connecting said switch to said fourth semi-rigid conductor.

29. The system of claim 23, wherein said first flexible conductor is electrically connected to said first semi-rigid conductor by one of crimping, soldering, spot welding and a connector.

30. The system of claim 23, wherein said housing includes a plurality of positioning cavities, at least one of said plurality of semi-rigid electrical conductors being selectively placed in at least one of said plurality of positioning cavities.

* * * * *

UNITED STATES PATENT AND TRADEMARK OFFICE

CERTIFICATE OF CORRECTION

PATENT NO. : 7,008,249 B2
APPLICATION NO. : 11/032860
DATED : March 7, 2006
INVENTOR(S) : McCoy et al.

It is certified that error appears in the above-identified patent and that said Letters Patent is hereby corrected as shown below:

TITLE PAGE, ITEM (73)
Assignee, please delete "Pant", and substitute therefore --Pent--.

COLUMN 6
At line 56, please delete "arid", and substitute therefore --and--.

COLUMN 8
At line 13, please delete "an(1", and substitute therefore --and--.

COLUMN 9
At line 1, following "and" and before "an", please delete "a".

Signed and Sealed this

Twenty-eighth Day of November, 2006

JON W. DUDAS
*Director of the United States Patent and Trademark Office*